United States Patent [19]

Kampfer et al.

[11] 4,138,211

[45] Feb. 6, 1979

[54] THERMOMECHANICAL CANDLE SNUFFER

[75] Inventors: Robert D. Kampfer, Lake Saint Croix Beach; Gunther H. Dierssen, White Bear Lake, both of Minn.

[73] Assignee: Minnesota Mining and Manufacturing Company, Saint Paul, Minn.

[21] Appl. No.: 848,489

[22] Filed: Nov. 4, 1977

[51] Int. Cl.[2] ..... F23Q 25/00

[52] U.S. Cl. ..... 431/35

[58] Field of Search ..... 431/33, 35

[56] References Cited

U.S. PATENT DOCUMENTS 1,308,215 7/1919 Baird ..... 431/35

*Primary Examiner*—Carroll B. Dority, Jr.

*Attorney, Agent, or Firm*—Cruzan Alexander; Donald M. Sell; Grady J. Frenchick

[57] ABSTRACT

Thermomechanical candle snuffer utilizes staff of material such as 55-Nitinol which, when heated by candle flame, elevates slideably engaged cap which falls over candle extinguishing it.

7 Claims, 7 Drawing Figures

THERMOMECHANICAL CANDLE SNUFFER

This invention relates to a candle snuffer and particularly to a thermally activated candle snuffer.

A source of fire hazard which is sometimes overlooked is the burning down or guttering of candles to a small puddle of hot burning wax. Furthermore, there may be excessive smoke formation causing damage or there are many occasions on which one is unable to check the burning of candles and overflowing wax may result in damage to candleholder or support. It is, of course, well-known to snuff out candles manually but such action requires constant supervision. So far as Applicants are aware no satisfactory means is available for performing this operation automatically at some predetermined point in the burning of the candle. There is accordingly a need for a simple device for extinguishing candles automatically at a predetermined point in their burning with substantial elimination of smoke or soot.

In accordance with this invention there is provided a thermomechanical candle snuffer consisting essentially of attaching means for attachment at a predetermined position on a candle, snuffing means which when lowered over the candle effectively extinguishes the flame and minimizes smoking and a staff secured to said attaching means and slideably engaging said snuffing means said staff being composed of a material having a critical temperature for recovery from plastic deformation at a temperature of about 40° to 100° C.

The most outstanding example of a material for construction of said staff is the group of nickel-titanium alloys developed at the U.S. Naval Ordinance Laboratory, White Oak, Maryland, U.S.A., and described and claimed in U.S. Pat. No. 3,174,851. These alloys are available under the generic name Nitinol with a prefixed number indicating percent of nickel. The alloys useful in the present invention are 55-Nitinols corresponding to the compound TiNi in which titanium and nickel are present in substantially equiatomic proportions and particularly such alloys which have been heat-treated as known in the art so that recovery from plastic deformation occurs at temperatures of about 40° to 160° C and preferably about 50° to 75° C. An extensive description of such alloys is provided by Buehler and Wang, *Ocean Engineering,* Vol. 1, pp. 105–120 (1968) where their recovery from plastic deformation is referred to as "mechanical memory."

The characteristic feature of "mechanical memory" is that a piece of the material, e.g. 55-Nitinol, is annealled to one shape and after plastic deformation recovers to tends to recover the same shape when heated above some particular recovery temperature. Thus, a piece of wire heat-treated and formed to a straight position can be coiled in a helix to give a spring. When the spring is heated above a critical temperature the spring straightens out. Such a spring may straighten merely by dropping into a cup of hot water so rapidly that it jumps out of the cup.

For use in the present invention the metal staffs are desirably straight in the heat-treated condition and are put in active position by deforming to an angle of about 60° to 120° depending on characteristics of the snuffing means. When warmed the material tends to resume its straight form. The cycle of bending and recovery can be repeated many times providing only that bending is always accomplished well below the temperature for recovery. In order to avoid too ready recovery, e.g., by body heat or running wax, the minimum recovery temperature should be 40° C or higher and preferably about 50° C. On the upper limit it is desirable that the recovery temperature not be excessively high. It appears that about 160° C is the maximum recovery temperature for such alloys, but it is preferable that the recovery temperature be lower and a temperature of 60° C or lower is adequate. The sensitivity of the staff can be enhanced by coating it with black to increase heat absorption but this is not necessary. Some heat may reach the staff by conduction from the snuffing means or cap or from the attaching means when these are sufficiently heat conductive and the geometry minimizes radiation.

The attaching means for attaching a candle snuffer of the invention to a candle can be of any form which will grasp the candle and it can even be the candle holder itself. In the simplest embodiment of the invention the means is a ring or springy part of a ring of slightly less diameter than the candle to which it is to be applied which can be up to 4 cm. Somewhat more complex are clip means such as alligator type clips actuated, for example, by springs, spring wires or screw clamps, to clasp the candle at a predetermined position. It is only necessary that the staff be secured to the attaching means at a position which is sufficiently close to the candle that heat from the flame will heat the staff to above its recovery temperature before the candle burns below the clasps of the attaching means. It is contemplated that the attaching means may be ornamental. It may be composed of whatever material may be desired. Preferably the means are composed of metal such as steel, brass, silver, aluminum, pewter, etc.

The snuffing means can be a simple conical cap of sufficient diameter and height to enclose the burning wick of the candle without depressing the wick into the gutter of wax surrounding it. Other shapes which will retain sufficient carbon dioxide around the wick to extinguish the flame can also be used. The snuffing means may be ornamental if desired and closed of any suitable non-flammable materials, preferably metals such as steel, brass, silver, alumina, pewter, etc. It is slideably engaged on the staff by a hole or slot near the outer edge of the same general shape as the cross-section of the staff and sufficiently larger so that it can slide on the staff when the latter has erected or straightened to some angle greater than about 90-100° under the influence of the heat of the candle flame. Dropping of the snuffing means occurs when its center of gravity is moved toward the candle by straightening of the staff so far that the center of gravity is closer to the candle than the base of the snuffing means.

Although the invention is here described with particular reference to the embodiment in which the candle snuffing means engages the staff slideably, it will be readily apparent that the engagement may be by attachment to the staff at a point such that activation will bring the candle snuffing means into operating position without sliding on the staff. In such an embodiment no retaining bend will be needed on the staff.

Having thus described the invention broadly, it is now more specifically described by reference to the accompanying drawings wherein:

Figure 1:
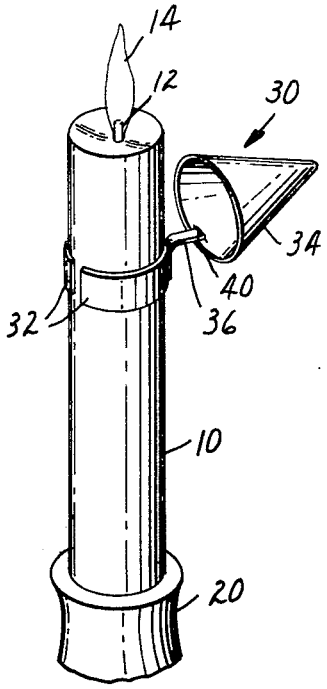
FIG. 1 shows a thermomechanical candle snuffer of the invention attached to a candle.
Figure 2:
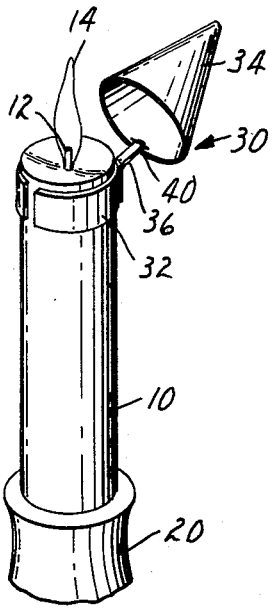
FIG. 2 shows the candle snuffer of FIG. 1 after the candle has burned down sufficiently so that the flame is beginning to heat the staff of the candle snuffer.
Figure 3:
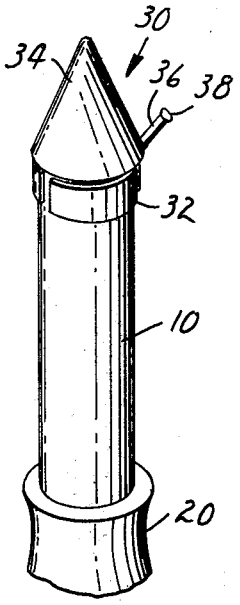
FIG. 3 shows the candle snuffer of FIGS. 1 and 2 after the staff has become sufficiently erect to actuate the snuffing action.
Figure 4:
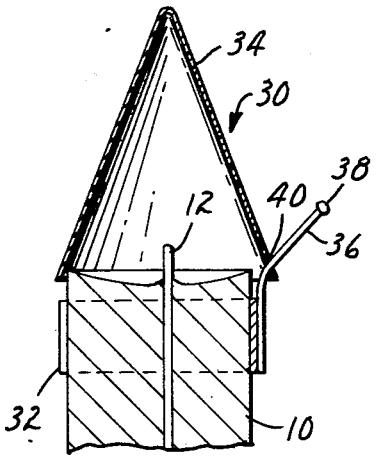
FIG. 4 shows a cross-section of the candle snuffer of FIG. 3.

Referring to the Figures where identical parts are identically numbered and with particular reference to FIGS. 1, 2, 3 and 4 it will be seen that candle (10) with wick (12) and flame (14) in holder (20) is provided with thermomechanical candle snuffer (30) of the invention having attaching means (32) candle snuffing means (34) and staff (36). Staff (36) is conveniently provided with retention bead (38) which serves to prevent candle snuffing means (34), seen to be a cone, from slipping off staff (36) with which it engages slideably through hole (40). Retention bead (40) may be of plastic or metal and may be constructed so as to fit the end of staff (36) or to engage therewith by means evident to those of skill in the art.

As noted previously staff (36) will best be made of 55-Nitinol. It is of greater width than thickness. Attaching means (32) should be springy so as to grasp candle (10) securely.

Figure 5:
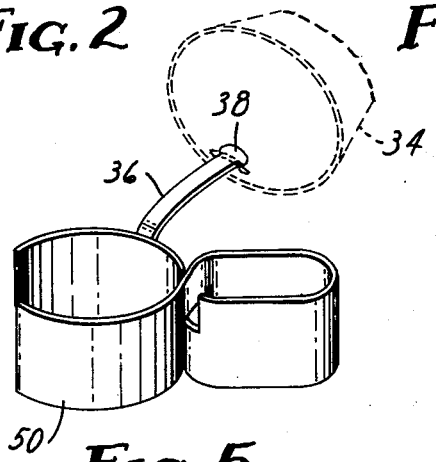
FIGS. 5 and 6 show embodiments of the invention having positive gripping forces.

FIG. 5 shows a different embodiment of the invention in which attaching means (50) is a single strip of material with staff (36) secured thereon, preferably metal, bent and notched in a well known configuration to provide attaching means.

Figure 6:
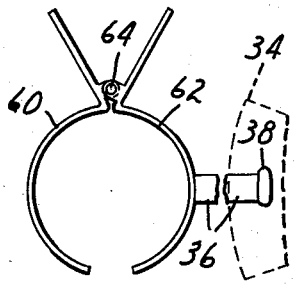

FIG. 6 shows still a further embodiment of the invention in which strips (60) and (62), the latter with staff (36) secured thereto, are attached with spring (64) to form a clip as attaching means.

Figure 7:
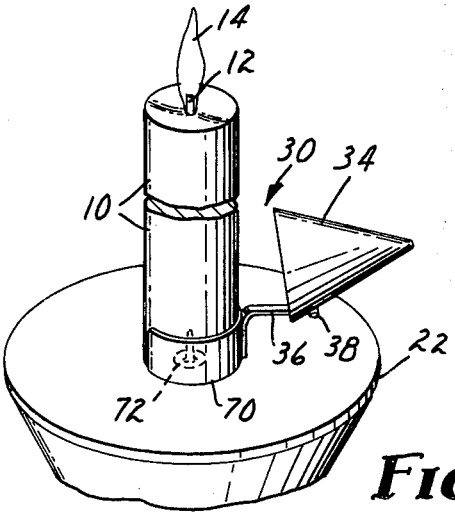
FIG. 7 shows an embodiment of the invention adapted to forming a candle holder.

FIG. 7 shows a further embodiment of the invention in which attaching means (70) with staff (36) may be inserted directly in candle holder (22) or may be integral therewith. If desired a stake (72) may be provided to secure the candle in the holder as is conventional in the art. The other parts of FIG. 7 are numbered as described above.

What is claimed is:

1. A thermomechanical candle snuffer comprising attaching means for attachment to a candle at a predetermined position, candle snuffing means for extinguishment of the flame of said candle and a staff, secured to said attaching means and engaging said candle snuffing means, composed of a material having a critical temperature for recovery from plastic deformation at a temperature of about 40° to 100° C.

2. A thermomechanical candle snuffer according to claim 1 wherein the candle snuffing means slideably engages the staff.

3. A thermomechanical candle snuffer according to claim 2 wherein the staff is composed of an alloy of titanium and nickel in substantially equiatomic proportions and has greater width than thickness.

4. A thermomechanical candle snuffer according to claim 2 wherein the attaching means clips to the candle at a predetermined point by spring action.

5. A thermomechanical candle snuffer according to claim 2 wherein the attaching means is at the base of the candle.

6. A thermomechanical candle snuffer according to claim 5 wherein the attaching means is integral with a candle holder for support of the candle.

7. The process for extinguishing a candle comprising positioning a staff of a normally straight piece of titanium-nickel alloy of substantially equiatomic proportions and greater width than thickness at a position on said candle where extinguishment is sought, bending said staff to an angle of about 60° to 120° and slideably engaging said staff in a slot in a cap of sufficient size as to be capable of covering the burning end of said candle and permitting the frame of said candle to warm the said staff after burning the candle to the point where extinguishment is sought whereby said staff tends to recover its normally straight condition and deposit said cap on the burning end of said candle.

* * * * *

UNITED STATES PATENT AND TRADEMARK OFFICE

CERTIFICATE OF CORRECTION

PATENT NO. : 4,138,211

DATED : February 6, 1979

INVENTOR(S) : Robert D. Kampfer and Gunther H. Dierssen

It is certified that error appears in the above-identified patent and that said Letters Patent are hereby corrected as shown below:

Column 1, line 53, "to" first occurrence should be -- or --.

Column 2, line 40, "closed" should be --composed--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*